United States Patent [19]

Hamilton

[11] Patent Number: 4,904,098

[45] Date of Patent: Feb. 27, 1990

[54] FLEXIBLE PRINT RIBBON SHIELD

[75] Inventor: Thomas A. Hamilton, Dalgety Bay, United Kingdom

[73] Assignee: Unisys Corporation, Blue Bell, Pa.

[21] Appl. No.: 150,806

[22] Filed: Feb. 1, 1988

[30] Foreign Application Priority Data

Sep. 5, 1987 [GB] United Kingdom ..... 8720912

[51] Int. Cl.[4] ..... B41J 35/04

[52] U.S. Cl. ..... 400/248; 400/645.1

[58] Field of Search ..... 400/247, 248, 642, 645.1, 400/229, 208

[56] References Cited

U.S. PATENT DOCUMENTS 3,874,285 4/1975 Kodaira et al. ..... 400/247

4,437,401 3/1984 Heinrich et al. ..... 400/248

*Primary Examiner*—David A. Wiecking

*Attorney, Agent, or Firm*—Mark T. Starr

[57] ABSTRACT

A print wheel impact printer in a document encoder comprises a flexible shield (38) made from laminar polyester sheet, the shield (38) having a shielding portion (40) at either end of which is provided a folded portion (44), each folded portion (44) being operative by virtue of non-90 degree fold lines and by virtue of the folds (50,52) forming at least three sides of a polyhedron to support the flexible shielding section distant from the print wheel (14). The shielding portion (44) is maintained tilted relative to the line between the hammer (26) and the print wheel (14) thereby to provide an opening (68) wherethrough the ink ribbon may be passed when an ink ribbon cassette (10) is changed. In operation the flexible shielding portion (40) is moved and carried by the paper (30), driven by the hammer (26), against the ink ribbon (12) and print wheel (14) with the paper (30) protruding through an aperture (42) in the shielding portion (40). Extraneous marking or blemishes created on the paper by contact with the ribbon (12) are thereby avoided.

9 Claims, 3 Drawing Sheets

FLEXIBLE PRINT RIBBON SHIELD

BACKGROUND OF THE INVENTION

The present invention relates to an apparatus for printing upon a document. In particular it relates to an apparatus including a print wheel and a hammer, the hammer being operative to urge the document against an ink ribbon and in turn for the ink ribbon to contact the print wheel and leave a record of a selected character upon the document.

The present invention is hereinafter described with reference to use in a document encoding machine. It is to be appreciated that the invention is not restricted to such use and can be used in numerous other types of apparatus where printing is required.

In a document encoding machine checks and other documents have data automatically read therefrom, have machine readable data printed thereon, and are processed such that amounts and/or quantities are automatically recorded. The checks and documents are passed from an input stack or pocket, through various processing stages, and are placed in or distributed among one or more output stacks or pockets.

The characters printed upon a check or other document are required to be machine readable at a later stage either by means of a magnetic reading device employed to read characters printed in magnetic ink or by means of an optical reading device which detects the visible outline of the printed characters and converts them to machine interpreted code.

It is to be appreciated that, in order for the automatic process of reading to be effective, printing must be as free of extraneous marks and blemishes as possible.

The present invention seeks to provide an impact printer capable of achieving the aim of blemish-free printing at low cost. The present invention seeks to achieve that aim without use of complex or precision parts.

In the prior art an impact printer was provided with a rotary print wheel. An ink ribbon was provided adjacent to a predetermined face of the print wheel. The print wheel would be turned about its axis of rotation until a selected character was adjacent to the ink ribbon. A hammer would move in a predetermined direction to strike a document towards the ink ribbon. The ink ribbon and document would together strike the print wheel and a visible record would be obtained. Because of the risk of the document inadvertently rubbing against the ink ribbon and leaving an extraneous mark or blemish, a ribbon shield was provided attached to a housing for the print wheel. The ink ribbon was passed about the leading edge of the housing between the print wheel and the document position. The shield was made from thin brass sheet and was rigid. Clearances were critical and the whole assembly could be damaged and require replacement and expensive setup should any mis-strike of the hammer cause damage or mere attrition or abrasion rub away the shield through extended use.

SUMMARY OF THE INVENTION

The present invention consists in an impact printer for printing on a presented document, said printer comprising: a hammer operative when in use to push the document against an ink ribbon and for the ink ribbon to be pressed in turn against a print wheel to leave a record of a selected character upon the document; and a shield between the document and said ink ribbon operative to prevent contact between a document and said ink ribbon unless said hammer is in use; said shield being flexible and, when the document is urged towards said ink ribbon by said hammer, said shield moving under pressure from the document towards said print wheel to allow contact between the document and said ink ribbon.

In the prior art it was known to leave a very wide gap in the ribbon shield for the document to have free contact with the ink ribbon when urged there-against by the hammer. This was necessitated by the large clearance required between the shield and the print wheel housing or print wheel so that the ink ribbon could be changed when exhausted. The wide gap presented a high risk of blemishing and extraneous marks being made upon the printed part of the document. The present invention seeks to improve upon the prior art in this respect by arranging that the shield have an aperture large enough to allow through-passage of the hammer and operative to permit a portion of the document to be displaced by the hammer through the aperture to make contact with the ribbon but otherwise operative to protect all those other parts of the document whereon printing is not required from coming into contact with the ink ribbon.

In the prior art the ink ribbon shield was a complex shape with rounded edges and precision formed. The present invention seeks to improve upon the prior art by providing a shield formed from a lamina, the lamina having a planar shielding portion across the active face of the print wheel; and first and second folded portions, one at each end of the shielding portion, operative to afford mechanical rigidity to either end of the shielding portion to support the shielding portion across the face of the print wheel and to allow the lamina to be attached in a fixed relationship with the print wheel.

In a further feature the present invention provides that the folded portions of the lamina each form portions of at least three faces of a polyhedron. This simple structure provides strength and rigidity without complexity of form or fabrication.

In order that the polyhedron may provide maximum strength and support to the shielding portion of the lamina the present invention also provides that the angle of the edge between the shielding portion and a side portion forming the face of the polyhedron in abutment therewith is not parallel to the projection of the axis of rotation of the print wheel, in the direction of movement of the hammer, onto the shielding portion of the lamina.

In the preferred embodiment the shielding portion is made generally in the form of a trapezoid with two edges parallel to the plane of rotation of the print wheel and a line of symmetry parallel to the axis of rotation of the print wheel, though assymetric shapes without parallel or straight sides can also be accommodated within the embodiment of the invention hereinafter described.

Preferably the present invention provides that the lamina is fabricated from polyester with a thickness in the region of 0.01 inch or 0.25 centimeters.

The prior art provided a fixed gap between the ink ribbon shield and the print wheel or its housing. This not only detracted from the efficiency of the ink ribbon shield by requiring that it be spaced away from the print wheel further than would otherwise be necessary but also required a precision setting of the gap between the ink ribbon shield and the ink ribbon itself so that the document, displaced by the hammer, could actually contact the ink ribbon without its resultant printed character being in an incorrect printing position for subsequent automatic reading. In order to remove this disadvantage the present invention provides that the flexible ink ribbon shield is disposed at an offset angle to the plane which lies at 90 degrees to the direction of approach of the hammer towards the print wheel. This leaves an opening between the shield and the print wheel which allows removal and replacement of the ink ribbon without requiring precise setting up of the gap between the ink ribbon and the shield.

BRIEF DESCRIPTION OF THE DRAWINGS

The invention is further explained, by way of an example, by the following description read in conjunction with the appended drawings in which.

DESCRIPTION OF THE PREFERRED EMBODIMENTS

Figure 1:
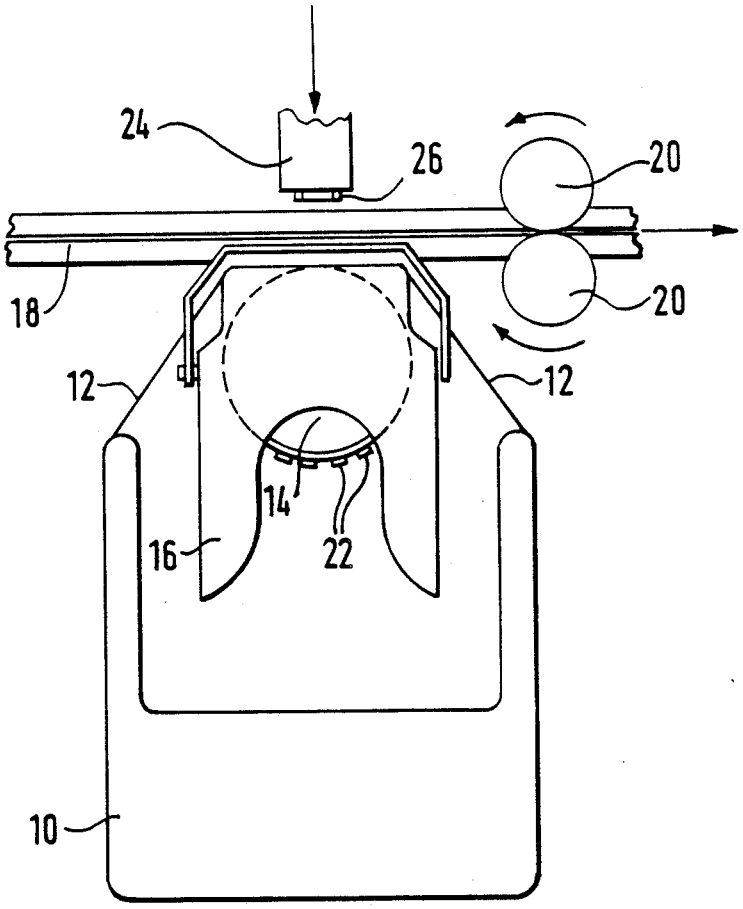
FIG. 1 shows a printing apparatus of the type wherein the present invention is embodied. The example shown relates particularly to the prior art, but it will be apparent from the subsequent description how the present invention relates thereto.

Referring to FIG. 1, an endless ink ribbon cassette 10 pays out an ink ribbon 12 around a print wheel 14 surrounded by a supportive housing 16. A document can be fed along a slotted track 18 by means of opposed pinch wheels 20 which grasp the document therebetween and rotate as indicated to urge the document along the track 18. The print wheel 14 is provided with areas of raised print 22. In operation a document is positioned in front of the print wheel 14 and a stepper motor (not shown) rotates the print wheel 14 about an axis of rotation (not shown, but projecting at a right angle to the plane of the paper as shown in FIG. 1) until a selected print character 22 is adjacent to the document. A solenoid 24 is then operated to propel a hammer 26 in a predetermined direction towards the document to cause the document to collide with the ink ribbon 12 and the selected character 22 on the print wheel 14 to leave a mark upon the document.

Figure 2:
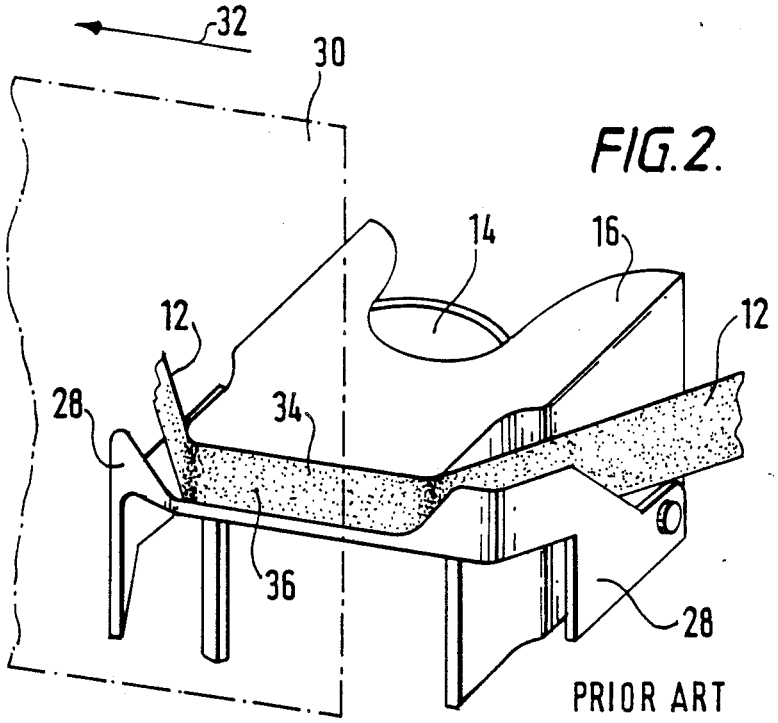
FIG. 2. PRIOR ART
FIG. 2 shows details of a print wheel assembly and ink ribbon shield according to the prior art.

In order that a document should not inadvertently brush against the ink ribbon and leave blemishes and other undesirable marks an ink ribbon shield 28, FIG. 2, is affixed to the print wheel housing 16 and maintains a clearance between a document in the track 18 and the ink ribbon 12 unless the hammer 26 is operated.

FIG. 2 shows the prior art solution to the problem of keeping a document clear of the ink ribbon 12, until the hammer 26 is operated.

The ink ribbon shield 28 according to the prior art has a complex shape. The shield 28 is fabricated from thin brass sheet of the order of 0.01 inch or 0.025 centimeters in thickness. In order to avoid tearing of the document 30 (shown in phantom outline and moved as indicated by the arrow 32) all edges of the ink ribbon shield 28 are rounded and polished. The clearance between the print wheel housing 16 which supports the ink ribbon 12 along its leading edge 34 and the ink ribbon shield 28 is carefully controlled so that it is possible to change the ink ribbon 12 by removal and replacement of the cassette 10. This causes a printing problem in that operation of the printer requires carrying the document 30 a considerable distance over the shield 28 onto the surface of the ink ribbon 12 for the ink ribbon 12 to impact the print wheel 14. The large distance between the shield 28 and the ink ribbon 12 necessitates provision of a very large cut-away area 36 if the document 30 is to be flexed and carried a sufficient distance by the hammer 26 to meet the ink ribbon 12. Should the document 30 otherwise buckle or distort for any reason there is a very high risk that it will touch the ink ribbon 12 at the cut-away area 36 and thus cause a blemish. This prior art compromise design allowing both replacement of the ribbon 12 and document shielding, because of the presence of the large cut-away area 36, seriously impairs the performance of the ink ribbon shield 28. Further, because the shield 28 is made from malleable brass, should any error of operation of the hammer or document be encountered, there is a high risk of the ink ribbon shield 28 being bent or distorted and requiring expensive and skilled replacement. The shield 28 can be abraded and rubbed away through long use. Should the prior art shield 28 be made of a plastics material, lack of dimensional stability could impede its effectiveness. Frangibility of any plastics material dimensionally stable enough to allow setting up of the clearance of the ink ribbon shield 28 also poses a problem.

Figure 3:
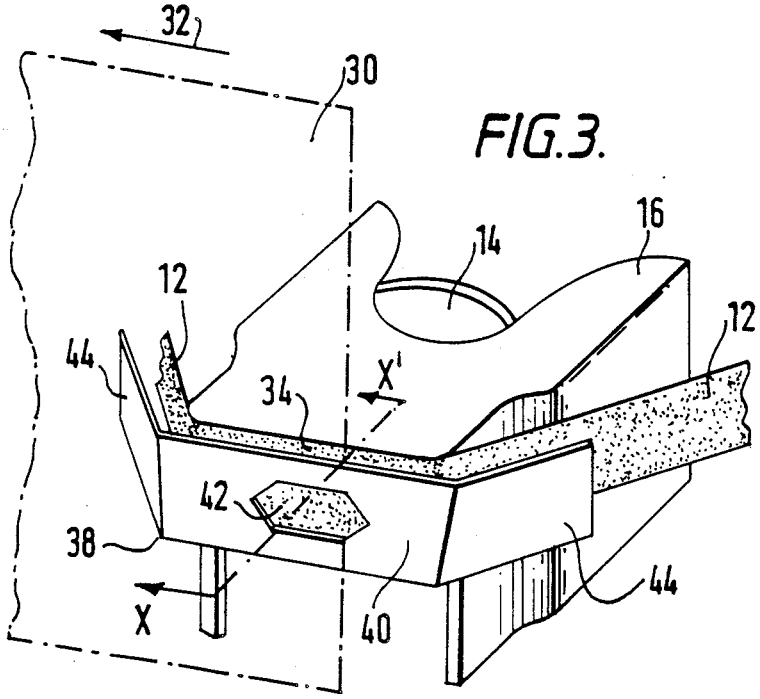
FIG. 3 shows a projected view of the ink ribbon shield and print wheel assembly according to the present invention.

FIG. 3 shows the solution according to the present invention.

The brass shield 28 of the prior art is replaced by a flexible shield 38. In the preferred embodiment of the present invention the flexible shield 38 is manufactured from polyester sheet material (that is, a lamina of uniform thickness) around 0.01 inch or 0.025 centimeters in thickness. The flexible shield 38 comprises a shielding portion 40 having an aperture 42 just large enough to allow through passage of the hammer 26 and that portion of a document carried forward by the hammer. The exact mechanism for printing using the flexible shield 38 is described below.

At either end of the shielding portion 40 of the flexible shield 38 there is provided a folded portion 43 whose folding provides mechanical rigidity and means for attaching the flexible shield 38 to the print wheel housing 16.

Figure 4:
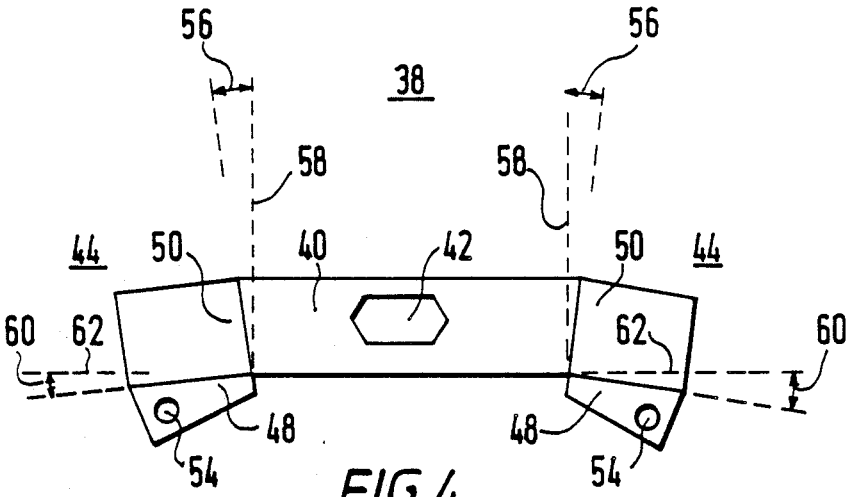
FIG. 4 shows the lamina (prior to bending or folding) from which the ink ribbon shield of the present invention is formed.

FIG. 4 shows the lamina used to form the flexible shield 38 prior to bending or folding. Each folded portion 43 has a side portion 44 and a base portion 48. The side portion 44 is joined to the shielding portion 40 with a first fold line 50. The base portion 48 is joined to the side portion 44 by means of a second fold line 52. Each base portion 48 is provided with a screw or stud fixing hole 54 whereby the flexible shield 38 can be affixed to the print wheel housing 16 when folding is complete.

The first fold line 50 forms a first angle 56 between its own direction and a primary reference direction 58 (here shown as a dotted line) being parallel to the projection of the axis of rotation of the print wheel 14 onto the plane of the shielding portion 40, the projection being in the direction of travel of the hammer 26 towards the print wheel 14 when the flexible shield 38 is assembled in its proper position as shown in FIGS. 1 and 3.

The second fold line 52 forms a second angle 60 with a secondary reference direction 62 (here also depicted as a dotted line 62), the secondary reference direction 62 being in a plane of the lamina and forming a right angle with the primary reference direction 58. When the base portion 48 is folded beneath the side portion 44 to lie with its plane approximately at 90 degrees to the plane thereof, and the side portion 44 is folded along the first fold line 50 for the plane of the side portion 44 to subtend a predetermined angle to the plane of the shielding portion 40, and when the flexible shield 38 is affixed to the print wheel housing 16 by means of the fixing holes 54, at either end of the shielding portion 40, the side portion 44, the base portion 48 and the shielding portion 40 each respectively form at least part of the surface of each of three faces of a polyhedron. This part-polyhedral folded structure is very strong and serves to support the shielding portion 40 at a fixed and predetermined distance from the leading edge 34 of the print wheel housing 16. Further, as will later be described, when the shielding portion 40 is flexed by document impact as the document 30 is urged by the hammer towards the print wheel 14, the existence of the first angle 56 of the first fold line 50 increases the strength of support of the shielding portion 40 and imparts to it more rigidity of support at its ends (that is to say, at the first fold line 50) than it would receive were the first fold line 50 parallel to the primary reference direction 58 and assists to ensure its precise and rapid elastic restoration.

In the described embodiment the shielding portion 40 is shown generally in the form of a trapezoid with two parallel straight sides and two angled sides, and also possessing a line of symmetry parallel to the axis of rotation of the print wheel. It is to be appreciated that the shielding portion can have different shapes without alteration to the described operation and function of the invention. For example, the sides shown parallel and straight can be non-parallel and curved without alteration to the operation of the invention as described. Equally, exact symmetry is not strictly necessary and non-symmetrical folded structures can be used without alteration to the described function and operation of the invention.

Figure 5:
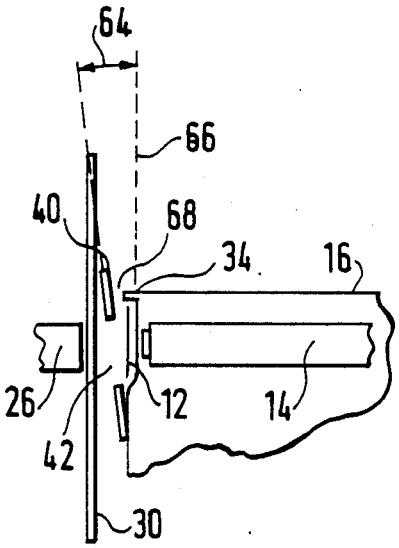
FIG. 5 shows a cross sectional view along the line X—X' of FIG. 3 (and including, in addition, the hammer of FIG. 1) indicating how the ink ribbon shield is tilted relative to the plane which lies at 90 degrees to the line of approach of the hammer to the print wheel permitting exchange of the ribbon.

FIG. 5 shows a cross-sectional view of FIG. 3 taken along the line X—X′ looking in the direction of the arrows and including the hammer 26. The angles 56, and 60 of the fold lines 50, and 52 and the position of fixing of the base portions 48 via the fixing holes 54 onto the print wheel housing 16 are all selected such that the shielding portion 40 of the flexible shield 38 forms an offset angle 64 between the plane of the shielding portion 40 and that plane 66 at a right angle to the direction of travel of the hammer 26 towards the print wheel 14. The existence of the offset angle 64 means that a gap or opening 68 is created through which the ink ribbon 12 may be removed and reintroduced when it is required to change the cassette 10.

Figure 6:
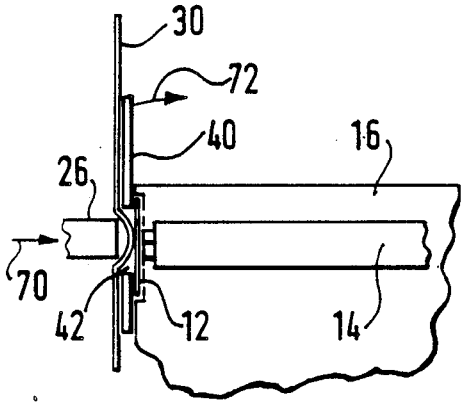
FIG. 6 shows the manner in which the document is urged by the hammer to bend back the flexible ribbon shield and push the document against the ink ribbon through the aperture in the flexible printing shield.

FIG. 6 shows the cross sectional view of FIG. 5 when the hammer 26 is operated. The hammer 26 when moved as indicated by the arrow 70 presses upon the document 30 which is urged towards the shielding portion 40. The document 30 on engaging the shielding portion 40 causes the shielding portion 40 to move as indicated by the arrow 72 towards the ink ribbon and print wheel. The aperture 42 in the shielding portion 40 is just large enough to allow passage of the hammer 26 together with that portion of the document 30 which is required to touch the ink ribbon 12. The remainder of the document 30 is protected from any contact by the flexible shield 38 thereby avoiding any extraneous printing and blemishes being passed from the ribbon 12 to the document 30 surface. The shielding portion 40 flexes back into its undisplaced position (spaced away from the print wheel 14 and ink ribbon 12) as soon as the hammer 26 is retracted. This ensures that the document 30 is not only kept well clear of the ink ribbon 12 whenever printing is not to take place (i.e. the hammer 26 is not operated) but also ensures that only that portion of the document 30 whereon printing is to be accomplished can come into contact with the ink ribbon 12.

The flexible shield 38 hereinbefore described can be used in impact printing devices other than those used in document encoding machines. Likewise the flexible shield 38 need not be attached to a print wheel housing 16 but can be attached in association with any part of the printing apparatus which retains a fixed physical relationship with the print wheel 14. Similarly the print wheel 14 can be replaced by a cylinder, a golfball or any other type character bearing surface.

The first fold lines 50 have hereinbefore been shown with a greater separation between their top ends (that is to say, those portions most remote from the track 18) than between their lower ends. It is to be appreciated that the present invention also encompasses the reverse situation, where mechanical strength is similarly imparted for the elastic restoration and support of the shielding portion 40. Similarly, the skilled man will be aware that in the present invention, forms of polyhedra other than that shown can be employed to impart rigidity to the folded portions 44 with the same purpose and result.

I claim:

1. An impact printer for printing on a presented document, said printer comprising:

a hammer operative when in use to push the document against an ink ribbon and for the ink ribbon to be pushed in turn against a rotatable print surface to leave a record of a selected character upon the document;

a shield disposed between the document and the ink ribbon to prevent contact other than when said hammer is in operation, said shield including a shielding portion having opposite extremities along its longitudinal axis, said shielding portion having at least one hole-like aperture and first and second folded portions integral respectively with said opposite extremities, said first and second folded portions being displaced relative to said shielding portion so that said shielding portion is disposed at an offset angle relative to the plane which lies at 90 degrees to the direction of approach of said hammer towards said print surface when said shield is mounted in its operative position in said impact printer by said first and second folded portions;

said shield being flexible and, when said document is pushed towards said ink ribbon by said hammer via said aperture, said shield moving under pressure from the document towards said print surface to allow contact between the document and said ink ribbon.

2. An impact printer according to claim 1 wherein said aperture is large enough to allow a portion of the document to be displaced by said hammer through said aperture to make contact with said ribbon.

3. An impact printer according to claim 1 wherein said shield comprises a lamina, a shielding portion of said lamina being planar and extensive across a face of said print surface, said lamina including said first and second folded portions, each of said folded portions of said lamina being comprised of a side portion and a base portion, said side portion being joined to said shielding portion at a first fold line and said base portion being joined to said side portion at a second fold line, said folded portions affording mechanical rigidity to support said shielding portion across said face of said print surface and allowing said lamina to be attached in association with said print surface.

4. An impact printer according to claim 3 characterized in that said first fold line is disposed at a first angle to a primary reference direction defined by the projection of the axis of rotation of the print surface, in the direction of movement of the hammer, onto the shielding portion of the lamina, said second fold line forming a second angle with a secondary reference direction lying in the plane of said lamina and forming a right angle with said primary reference direction, said base portion being folded beneath said side portion such that it lies in a plane substantially 90 degrees to the plane of said side portion, said side portion being folded along said first fold line such that the plane of said side portion subtends a predetermined angle to the plane of said shielding portion.

5. An impact printer according to claim 4 wherein each side and base portion of one of said folded portions and the adjacent shielding portion of said lamina form at least three faces of a polyhedron.

6. An impact printer according to claim 4 including a housing for supporting said print surface, the respective base portions of said first and second folded portions being attached to said housing whereby a fixed physical relationship is maintained between said shield and said print surface.

7. An impact printer according to claim 6 wherein said offset angle is greater than zero degrees, the magnitude of said offset angle being a function of said first and second angles of each of said folded portions and the location on said housing at which said base portion is affixed, said offset angle being operative to provide an opening between said shield and said print surface allowing removal and replacement of said ink ribbon.

8. An impact printer according to claim 3 wherein said lamina is a polyester lamina.

9. An impact printer according to claim 3 wherein the thickness of said lamina is in the region of 0.01 inch or 0.025 centimeters.

* * * * *